United States Patent [19]

Kaminaga

[11] Patent Number: 4,619,092

[45] Date of Patent: Oct. 28, 1986

[54] CURTAIN WALL PANEL SUPPORTING DEVICE

[75] Inventor: Hiromitsu Kaminaga, Kurobe, Japan

[73] Assignee: Yoshida Kogyo K. K., Tokyo, Japan

[21] Appl. No.: 711,831

[22] Filed: Mar. 14, 1985

[30] Foreign Application Priority Data

Mar. 22, 1984 [JP] Japan ..... 59-39961[U]

[51] Int. Cl.[4] ..... E04B 7/14

[52] U.S. Cl. ..... 52/235; 52/302; 52/393; 52/403; 49/DIG. 1

[58] Field of Search ..... 52/235, 403, 393, 302, 52/303, 304, 209, 395; 49/DIG. 1

[56] References Cited

U.S. PATENT DOCUMENTS

| | | | |
|---|---|---|---|
| 4,448,001 | 5/1984 | Whitimeyer | 52/302 |
| 4,486,992 | 12/1984 | Gartner | 52/235 |

FOREIGN PATENT DOCUMENTS

| | | | |
|---|---|---|---|
| 1183658 | 12/1964 | Fed. Rep. of Germany | 52/235 |
| 1509459 | 1/1969 | Fed. Rep. of Germany | 52/235 |
| 2806104 | 8/1979 | Fed. Rep. of Germany | 52/403 |
| 2376266 | 9/1978 | France | 52/235 |
| 27047 | 2/1984 | Japan . | |

OTHER PUBLICATIONS

Progressive Architecture, Apr. 1960, pp. 206–207, Owens-Illinois Advertisement for Thinlite.

*Primary Examiner*—William F. Pate, III
*Assistant Examiner*—Richard E. Chilcot, Jr.
*Attorney, Agent, or Firm*—Hill, Van Santen, Steadman & Simpson

[57] ABSTRACT

A curtain wall panel supporting device in which batten members are connected to one side faces of right and left vertical frame members and upper and lower horizontal frame members through connection members having a heat insulating property to constitute a rectangular frame having concave grooves which are contiguous along the four inner peripheries of the frame and which are open in vertical and transverse directions with respect to the curtain wall plane, and panel (6) is grippingly supported in those concave grooves through room-inside and-outside seal members to form spaces between the panel (6) and the concave grooves which spaces are contiguous along the four inner peripheries of the frame and are open to the outside air, and the portions of the connection members facing the concave grooves are covered with the room-inside seal members. Such covering of the connection members with the room-inside seal members prevents rain water from adhering to and freezing on the connection members, which therefore will not be deteriorated in their heat insulating.

3 Claims, 6 Drawing Figures

CURTAIN WALL PANEL SUPPORTING DEVICE

BACKGROUND OF THE INVENTION

1. Field of the Invention

The present invention relates to a curtain wall panel supporting device.

2. Description of the Prior Art

As disclosed in Japanese Patent Laid Open Publication No. 27047/84, there is known a panel supporting device in which batten members are fixed to one side face of a rectangular frame through heat insulatable connection members, further vertical and horizontal concave grooves are formed by being surrounded by the frame, the connecting members and the batten members which grooves are contiguous along the four inner peripheries of the frame and being open toward the inside of the rectangular frame, and further a panel is fitted in the concave grooves so that the four outer peripheries of the panel are inserted into the concave grooves, respectively, so as to form spaces between the outer peripheral edges of the panel and the bottoms of the concave grooves which spaces are contiguous along the four inner peripheries of the frame and allowed to communicate with the outside air through through-holes formed in the batten members.

With such structure, the panel supporting device is superior in heat insulation and the spaces are kept equal in pressure to the outside air, so the penetration of rain water caused by the pressure difference, etc. can be surely prevented under the theory of equal pressure; besides, rain water or the like which has penetrated into the spaces by some cause or another can be easily drained to the exterior without penetrating into the room-inside.

However, since the heat insulatable connection members are exposed to the spaces, rain water or the like which has penetrated into the spaces may adhere to the connection members and be frozen thereby with extension between the frame member and the batten member, thus resulting in various disadvantages. For example, the exterior heat is transmitted through the frozen portions directly into the room and the connection members are deteriorated in heat insulation performance by the freezing; besides, since the outside air, rain water, etc. directly act on and contact the connection members, the connection members become timeworn and debased in heat insulation performance.

SUMMARY OF THE INVENTION

It is the object of the present invention to provide a curtain wall panel supporting device superior in heat insulation and capable of surely preventing the entry of rain water or the like under the theory of equal pressure, easily draining to the exterior rain water or the like which has entered from the exterior, ensuring the heat insulation performance of the connection members against frozen rain water or the like and maintaining a superior heat insulation performance over a long period while minimizing deterioration and decrepitude.

According to the present invention there is provided a curtain wall panel supporting device in which, in order to achieve the above-mentioned object, the portions of the connection members facing concave grooves are covered with room-inside seal members which support a panel grippingly within the concave grooves.

BRIEF DESCRIPTION OF THE DRAWINGS

The accompanying drawings illustrate an embodiment of the present invention, in which.

DESCRIPTION OF A PREFERRED EMBODIMENT

An embodiment of the present invention will be described hereinunder with reference to the drawings.

Figure 1:
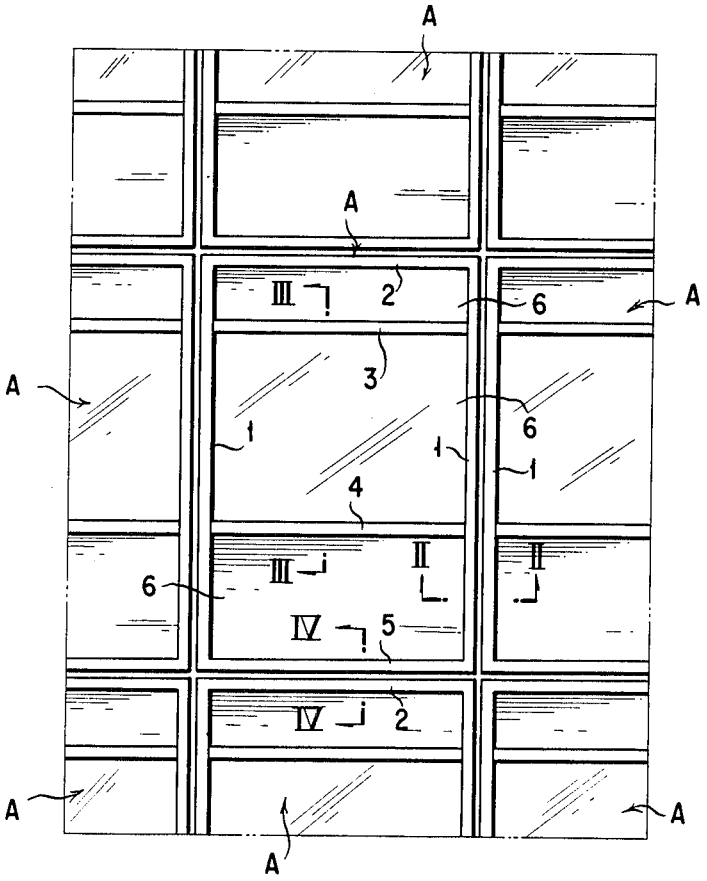
FIG. 1 is a schematic front view of part of a building using a curtain wall.

Referring to FIG. 1, there is shown part of a building using a curtain wall, in schematic front view, in which an upper horizontal member 2, an upper intermediate horizontal member 3, a lower intermediate horizontal member 4 and a lower horizontal member 5 are mounted between right and left vertical members 1 to constitute plural frame portions, in each of which is fitted a panel 6 to constitute a unit curtain wall A, and plural such unit curtain walls A are mounted continuously in vertical and transverse directions.

Figure 2:
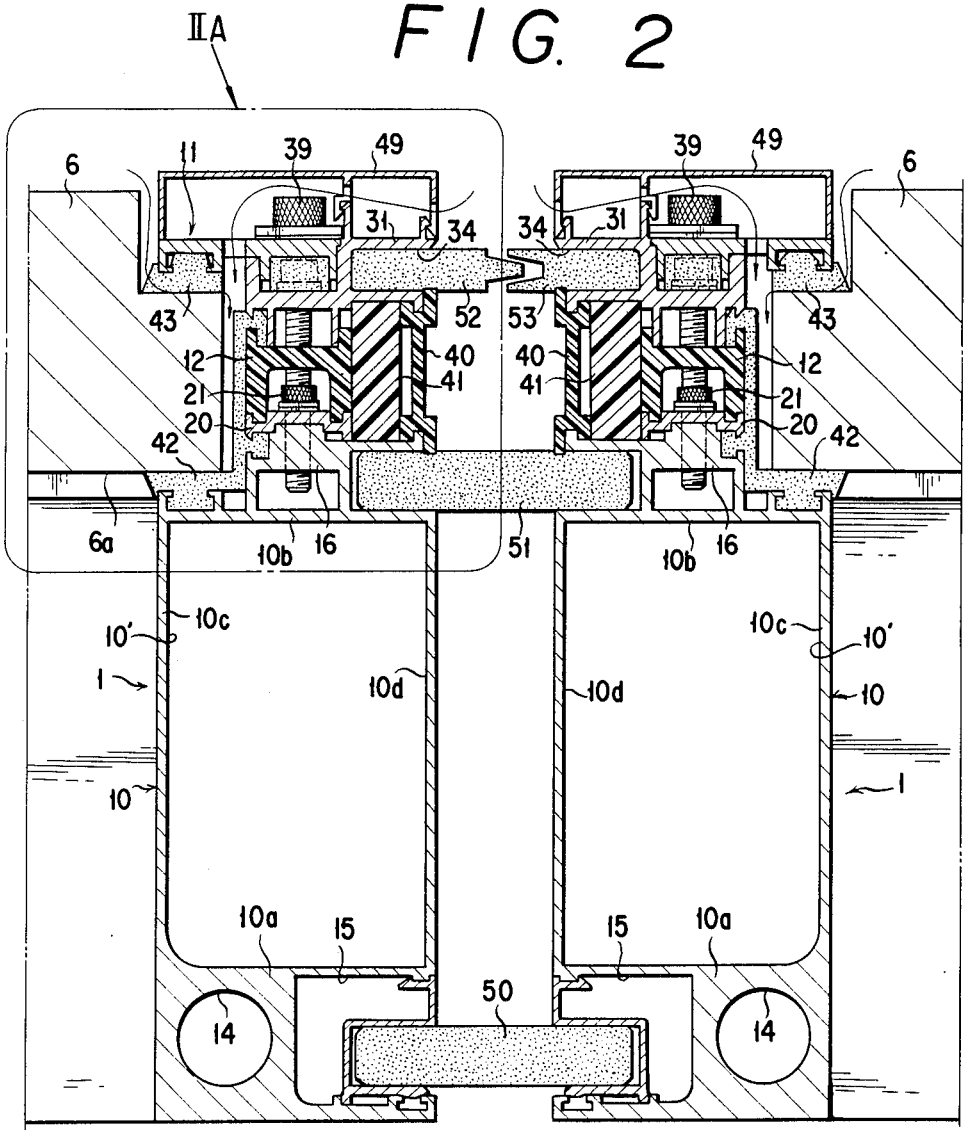
FIGS. 2, 3 and 4 are sectional views taken on lines II—II, III—III and IV—IV, respectively, of FIG. 1.
Figure 2A:
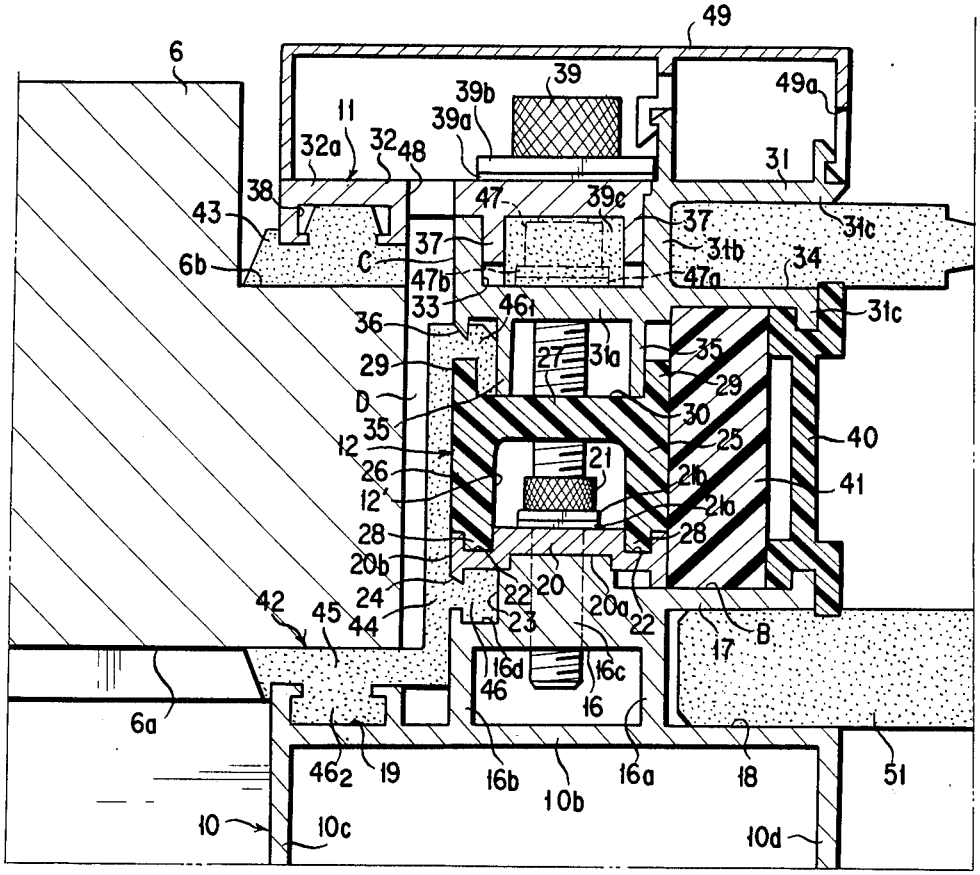
FIG. 2A an enlarged view of a portion IIA of FIG. 2.

Referring now to FIG. 2, a sectional view taken on line II—II of FIG. 1, the vertical member 1 comprises a vertical frame 10 and a vertical batten member 11 which are interconnected through a vertical connection member 12 having a heat insulating property. The connection members are made of metamorphic PPO, rigid PVC, ABS resin, etc.

The vertical frame 10 is an elongated frame having a hollow portion 10' which is formed by room-inside and -outside walls **10*a* and 10*b* and inner and outer walls 10*c* and 10*d* and which serves as an air passage. The room-inside wall 10*a*, which is thickwalled, has a hole 14 serving as a heat transfer medium passage and an outward concave portion 15. At a central portion in the transverse direction of the room-outside wall 10*b* is integrally formed a mounting frame 16 which is ]-shaped by both side walls 16*a* and 16*b* and a connection wall 16*c*. The connection wall 16*c* of the mounting frame 16 extends outwards to form an extension wall 17, and an outward concave groove 18 is formed by the extension wall 17, one side wall 16*a* and room-outside wall 10*b*, a seal member mounting groove 16*d* is formed in the connection between the connection wall 16*c* and the other side wall 16*b*, and a concave groove 19 is formed on the side of the inner wall 10*c* of the room-outside wall 10*b***.

Further, a concave portion **20*a* of an attachment 20 is fitted on the connection wall 16*c* of the mounting frame 16 and it is held in place with a connecting bolt 21. On both right and left sides of the attachment 20 are formed a pair of concave portions 22 as engaged portions which are open toward the room outside, and an inwardly opened concave groove 23 is formed by one side 20*b* and the concave portion 16*d*, with a pawl 24 being formed integrally with one side 20*b***.

The connection member 12 is in a ]-shaped. formed by both side walls 25 and 26 and a connection wall 27 and having a width smaller than that of the vertical batten member 11. It has a housing portion 12' capable of housing therein the head portion of the connecting bolt 21, and the fore end portions of the side walls 25 and 26 are notched to form a pair of engaging portions 28 adapted to fit in the paired concave portions 2, while the base end portions of the side walls 25 and 26 are notched to form a pair of engaged portions 29, which form together with the connection wall 27 a concave portion 30 facing the room outside.

The vertical batten member 11 comprises a first batten portion 31 and a second batten portion 32, and has the same width as the vertical frame 10. The first batten portion 31 has a mounting wall 31*a*, a projecting wall 31*b* projecting toward the room outside and a pair of outward walls 31*c*, thereby forming a concave portion 33 which is open toward the room outside. Between the outward walls 31*c* is formed an outward concave groove 34, while on both side portion of the mounting wall 31*a* are formed a pair of projections 35 and on an inner end portion thereof is formed a pawl 36. The paired projections 35 are brought into abutment with the connection wall 27 of the connection member 12 and fixed with a connecting bolt 47 to the connection wall 16*c* of the mounting frame 16 together with the connection member 12. The head portion of the connecting bolt 47 is received in the concave portion 33.

The second batten portion 32 includes a horizontal wall 32*a* and a pair of projecting walls 37 formed integrally with the horizontal wall 32*a* so as to fit in the concave portion 33, and at an inner side portion of the horizontal wall 32*a* is formed a concave groove 38 which is open toward the room inside. The paired projecting walls 37 are fitted in the concave portion 33 and fixed with a connecting bolt 39 to the mounting wall 31*a* of the first batten portion 31.

The bolts 21, 47 and 39 are tightened and fixed through seal packings 21*a*, 47*a* and 39*a* and washers 21*b*, 47*b* and 39*b* so that rain water, outside air, etc. may not penetrate the interior through the bolt insertion holes.

Between the mounting wall 31*a* of the first batten portion 31 and the horizontal wall 32*a* of the second batten portion 32 is held an elastic packing 39*c* which is generally in the form of rectangular parallelopiped and which is centrally formed with bolt shank inserting through holes. The shank portion of each connecting bolt 39 extends through the through hole of the elastic packing 39*c* and are threadedly engaged with the second batten portion 32. Such arrangement prevents the leakage of water from the bolt shank inserting holes.

Thus, it is possible to position and mount the connection member 12 with respect to the attachment 20 which is fixed to the vertical frame 10, also position and mount the first batten portion 31 with reference to the connection member 12, and further position and mount the second batten portion 32 to the first batten portion 31. Consequently, the vertical frame 10 and the presser edge member 11 can be easily positioned and connected through the connection member 12.

Since the connection member 12 is smaller in width than the vertical frame 10 and the batten member 11, concave grooves B and C which are open outwards and inwards respectively are formed by the side walls 25 and 26 of the connection member 12, the vertical frame 10 and the batten member 11, and the panel 6 is fitted in the inwardly open concave groove C.

Further, between an end portion of the extension wall 17 and an end portion of one outward wall 31*c* is mounted an auxiliary connection member 40 formed of a heat insulating material in a position approximately aligned with the outer wall 10*d* of the vertical frame 10, and a heat insulator 41 is disposed between the auxiliary connection member 40 and one side wall 25 of the connection member 12 to prevent heat loss caused by radiation and convection thereby improving the heat insulating characteristic. At the same time, the outwardly open concave groove B is thereby closed to prevent the vertical frame 10 and the batten member 11 from being displaced toward one concave groove B. Therefore, the other concave groove C is not opened and so the panel 6 can be held in place firmly.

The panel 6 is fitted in the concave groove C which is open inwardly in the transverse direction with respect to the curtain wall plane, and it is held between room-inside and -outside seal members 42 and 43 which are made of a synthetic rubber, a non-rigid synthetic resin, etc. assuring heat insulating property and water-tightness. The room-inside seal member 42 is in a hook-like bent shape formed by a first sealing piece 44 which is in contact with the other side wall 26 of the connection member 12 and which extends in a direction orthogonal to the curtain wall plane, and a second sealing piece 45 which is in contact with a room-inside face 6*a* of the panel 6 and which extends transversely with respect to the curtain wall plane. At an intermediate portion of the first sealing piece 44 is integrally formed an intermediate mounting portion 46 which is fixedly held in the concave groove 23 formed by the concave portion 16*d* of the mounting frame 16 and the other side 20*b* of the attachment 20. Further, the pawl 24 firmly bites the intermediate mounting portion 46, and a hook-like bent, fore end mounting portion $46_1$ is integrally formed at the fore end portions of the first sealing piece 44. The fore end mounting portion $46_1$ fits over the engaged portion 29 of the connection member 12 and is pressed down by the mounting wall 31*a* of the first batten portion 31, that is, the fore end mounting portion $46_1$ is held and fixed between the mounting wall 31*a* and the engaged portion 29. Besides, the pawl 36 firmly bites the fore end mounting portion $46_1$. Thus, the first sealing piece 44 covers the other side wall 26 of the connection member 12, namely, the portion of the connection member which faces the concave groove C.

The second sealing piece 45 is integrally formed with a mounting portion $46_2$. The mounting portion $46_2$ is fitted in the concave groove 19 formed on the room-outside wall 10*b* of the vertical frame 10 and thereby secured firmly to the vertical frame 10.

The room-outside seal member 43 is fitted in the concave groove 38 and is in pressure contact with a room-outside face 6*b* of the panel 6.

Thus, the panel 6 is grippingly supported in the concave groove C by the room-inside and -outside seal members 42 and 43, and between its end face 6*c* and the bottom portion of the concave groove C or the first sealing piece 44 is formed a space D which is open to the outside air through a through hole 48 of the second batten portion 32 and a through hole 49*a* of a vertical cover 49.

Consequently, the space D and the outside air become equal in pressure to improve sealability of the panel mounting portion. Besides, since the portion of the connection member 12 which faces the concave groove C is covered with the first sealing piece 44, there will be no adhesion and freezing of rain water or the like which has entered the space with respect to the connection member 12, nor will there be a direct contact of the outside air with the connection member 12, thus preventing the connection member 12 from becoming timeworn and deteriorated in heat insulation performance in an early stage.

A room-inside packing band 50 is disposed between the outward concave portions 15 in the vertical members 1 of transversely adjacent unit curtain walls A, while between the outward concave grooves 18 is disposed an intermediate packing band 51. Further, between the outward concave grooves 34 is disposed first and second room-outside packing bands 52 and 53 which are opposed to each other. The auxiliary connection members 40 somewhat bite the intermediate packing band 51 and the first and second room-outside packing bands 52 and 53 and are thereby connected thereto.

Figure 3:
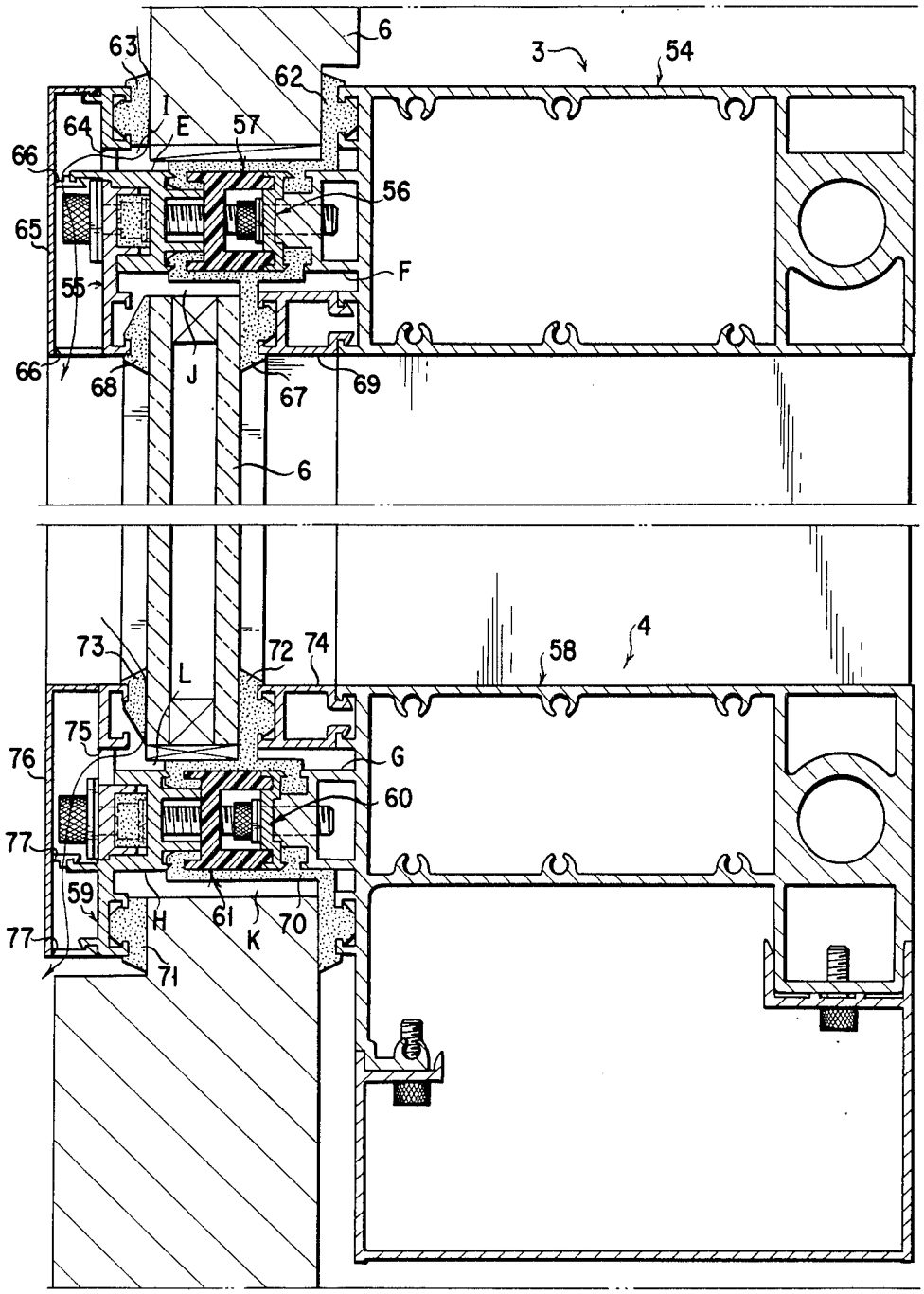

Referring now to FIG. 3, there is described a sectional view taken on line III—III of FIG. 1, in which the upper intermediate horizontal member 3 includes a horizontal frame 54 and a horizontal batten member 55 which are interconnected through an attachment 56 and a horizontal connection member 57 formed of a heat insulating material to constitute upper and lower concave grooves E and F.

The lower intermediate horizontal member 4 includes a horizontal frame 58 and a horizontal presser edge member 59 which are interconnected through an attachment 60 and a horizontal connection member 61 formed of a heat insulating material to constitute upper and lower concave grooves G and H.

The batten members, 55, 59, the attachments 56, 60 and the connection members 57, 61 are of the same shapes and connected in the same fashion as the presser edge member 11, attachment 20 and connection member 12, respectively, of the vertical member 1, so explanations thereon are here omitted.

In the upper concave groove E of the upper intermediate horizontal member 3 is grippingly supported the panel 6 through room-inside and -outside seal members 62 and 63. The room-inside and -outside seal members 62 and 63, which are of the same shapes as the room-inside and -outside seal members 42 and 43, respectively, of the vertical member 1, cover the portion of the connection member 57 which faces the concave groove E and at the same time form a space I between them and the panel 6. The space I is open to the outside air through a through hole 64 of the presser edge member 55 and a through hole 66 of a horizontal cover 65.

In the lower concave groove F is grippingly supported a double glass through room-inside and -outside seal members 67 and 68. Like the room-inside seal member 42, the room-inside seal member 67 covers the portion of the connection member 57 which faces the concave groove F and forms a space J between it and the panel 6; further, it is connected to the horizontal frame 54 through a mounting member 69.

In the concave groove H below the lower intermediate horizontal member 4 is grippingly supported the panel 6 through room-inside and -outside seal members 70 and 71. The room-inside and -outside seal members 70 and 71, which are of the same shapes as the room-inside and -outside seal members 42 and 43, respectively, of the vertical member 1, cover the portion of the connection member 61 which faces the concave groove H and form a space K between them and the panel 6.

In the upper concave groove G is grippingly supported a double glass as the panel 6 through room-inside and -outside seal members 72 and 73. Like the room-inside seal member 42, the room-inside seal member 72 covers the portion of the connection member 61 which faces the concave groove G and forms a space L between it and the panel 6; further, it is connected to the horizontal frame 58 through a mounting member 74. The space L is open to the outside air through a through hole of the batten member 59 and a through hole 77 of a horizontal cover 76.

Figure 4:
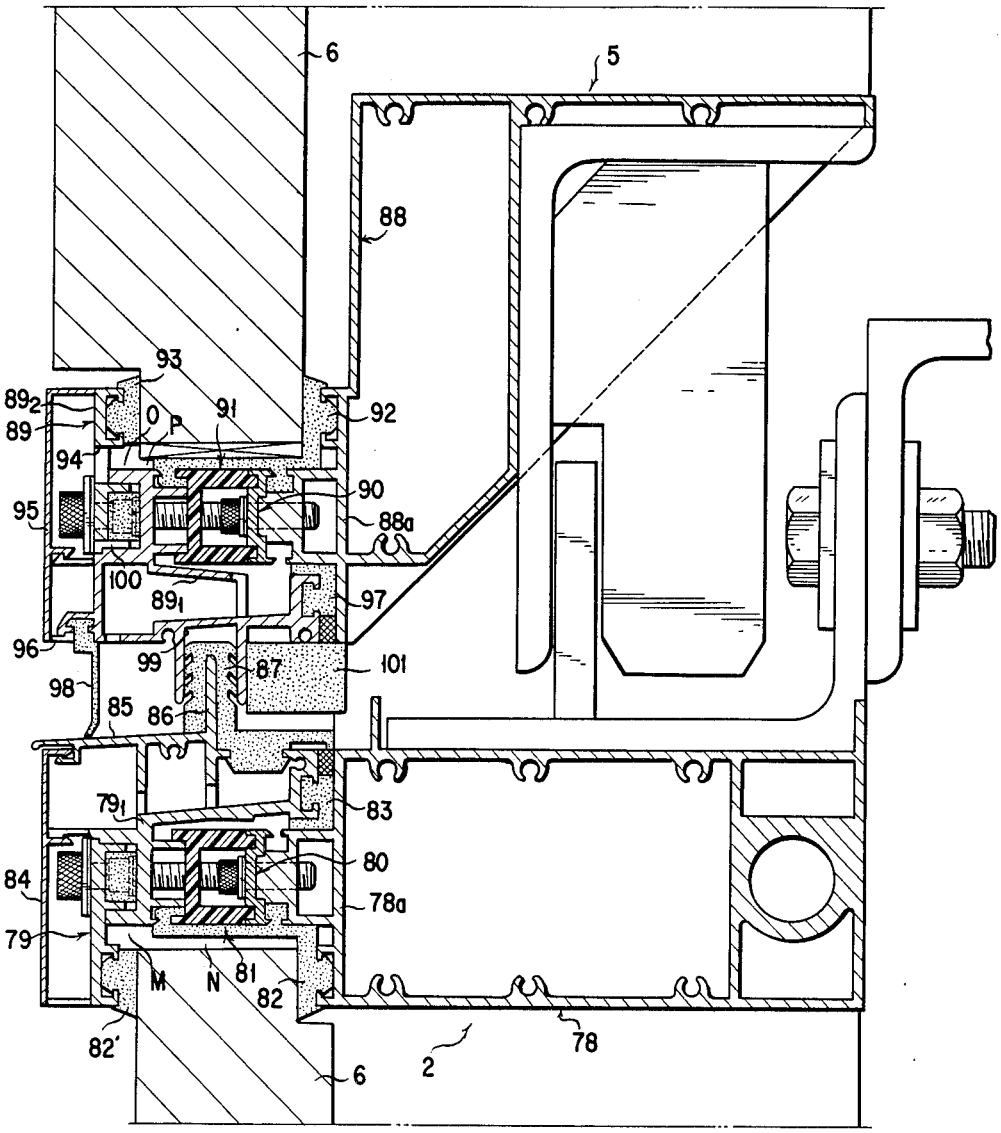
Figure 5:
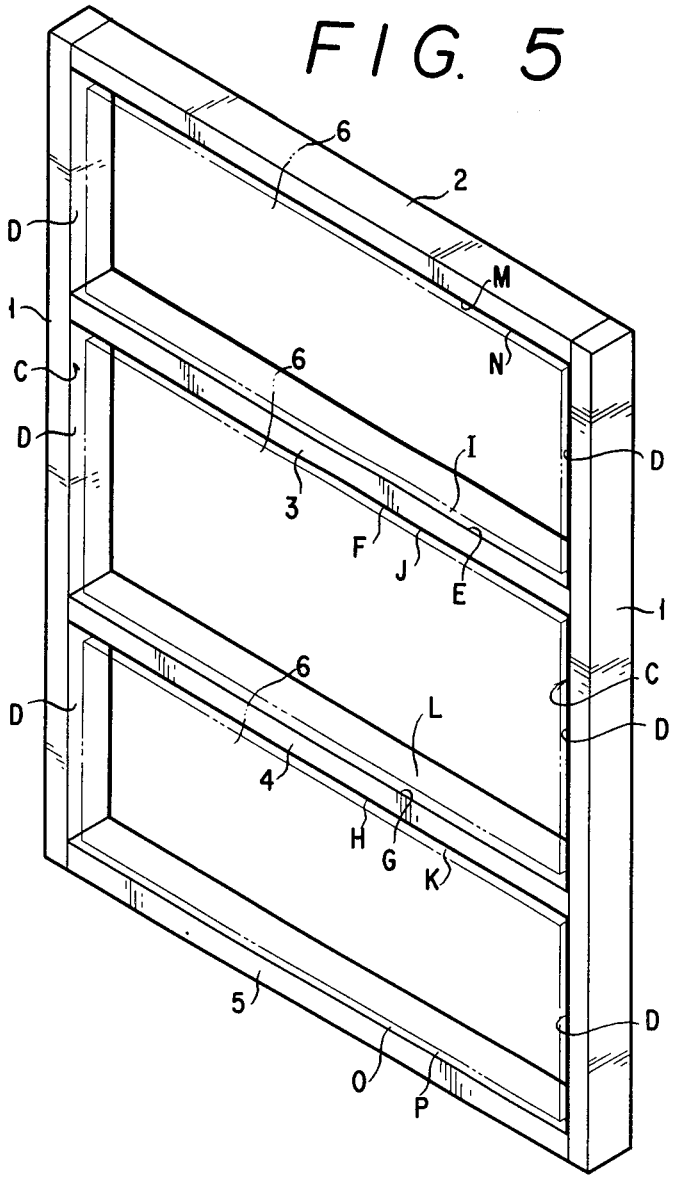
FIG. 5 is a schematic perspective view of a unit curtain wall.

Referring now to FIG. 4, there is described a sectional view taken on line IV—IV of FIG. 1, in which the upper horizontal member 2 includes a horizontal frame 78 and a horizontal batten member 79 which are interconnected in the same manner as previously noted through an attachment 80 and a connection member 81 formed of a heat insulating material to constitute a downward concave groove M. In the concave groove M is grippingly supported an upper portion of the panel 6 through room-inside and -outside seal members 82 and 82' in the same fashion as previously described to form a space N. The room-inside seal member 82 covers the portion of the connection member 81 which faces the concave groove M.

A first batten portion $79_1$ of the batten member 79 is in abutment with a room-outside wall 78*a* of the horizontal frame 78 through a seal member 83 and is retainingly engaged with an upper portion of a horizontal cover 84. And it has a drip piece 85 and a rising piece 86, with a seal member 87 being fitted over the rising piece 86.

The lower horizontal member 5 includes a horizontal frame 88 and a horizontal batten member 89 which are interconnected in the same fashion as previously indicated through an attachment 90 and a connection member 91 formed of a heat insulating material to constitute an upward concave groove 0. In the concave groove 0 is grippingly supported a lower end portion of the panel 6 through room-inside and -outside seal members 92 and 93 to form a space C. The room-inside seal member 92 covers the portion of the connection member 91 which faces the concave groove 0, and the space P is open to the outside air through a through hole 94 formed in a second batten portion $89_2$ of the batten member 89 and a through hole 96 of horizontal cover 95.

A first batten portion $89_1$ of the batten member 89 is in abutment with a room-outside wall 88*a* of the horizontal frame 88 through a seal member 97, and a sealing piece 98 is attached to a room-outside part of the first batten portion $89_1$, with a concave groove 99 being formed in an intermediate part. The sealing piece 98 is in abutment with the drip piece 85 and the seal member 87 is fitted in the concave groove 99 to seal the connection between the upper and lower horizontal members 2 and 5.

The reference numeral 100 denotes a rain water draining notch and the numeral 101 denotes a heat insulating sponge for prevention of dew with the above arrangement, in the interior of the rectangular frame composed of the right and left vertical members 1, upper horizontal member 12 and upper intermediate horizontal member 3 are formed the concave grooves C, M, C and E which are contiguous along the four sides of the frame, and between these concave grooves and the panel 6 fitted in the rectangular frame are formed the spaces, D, N, D and I which are contiguous along the four sides of the frame and which are open to the outside air.

Moreover, in the interior of the rectangular frame composed of the right and left vertical members 1, upper intermediate horizontal member 3 and lower intermediate horizontal member 4 are formed the concave grooves C, F, C and G which are contiguous along the four sides of the frame, and between these concave grooves and the panel fitted in the rectangular frame are formed the spaces D, J, D and L which are contiguous along the four sides of the frame and which are open to the outside air.

Further, in the rectangular frame composed of the right and left vertical members 1, lower intermediate horizontal member 4 and lower horizontal member 5 are formed the concave grooves C, H, C and O which are contiguous along the four sides of the frame, and between these concave grooves and the panel 6 fitted in the rectangular frame and formed the spaces D, K, D and P which are contiguous along the four sides of the frame.

Therefore, the spaces which are contiguous along the four sides of the frame can be made equal in pressure to the outside air to provide a positive prevention of rain water, etc. under the theory of equal pressure, and even in the event of entry of rain water or the like into those spaces, an easy draining to the exterior can be ensured.

Moreover, since the portions of the connection members 12, 57, 61, 81 and 91 which face the concave grooves C, E, F, G, H, M and O are covered with the room-inside seal members 42, 62, 67, 70, 72, 82 and 92, it is not possible at all that rain water which has penetrated from the outside of the room will adhere to the connection members and freeze thereon or the outside air will directly contact the connection members. Therefore, no possibility exists that the connection members will become decrepit and deteriorated in their heat insulating performance in an early stage.

Further, since the frame portions and the batten portions are connected through the heat insulatable connection members to form concave grooves and the panel is grippingly supported in these concave grooves, there can be obtained a panel supporting device superior in heat insulating performance.

What is claimed is:

1. A curtain wall panel supporting device comprising:

(a) a rectangular frame formed by right and left vertical frame members of a curtain wall unit having opposed inner and outer sides, upper and lower horizontal frame members of the curtain wall unit, connecting members having a heat insulating property and fixedly secured to the outer side of said vertical and horizontal frame members, and batten members fixedly secured to the outer side of said connection members;

(b) a panel mounted into said rectangular frame; and (c) seal members provided between said rectangular frame and said panel, wherein said batten members are connected to respective one outer side faces of said vertical and horizontal frame members through said connection members, and said rectangular frame has concave grooves which are contiguous along the four inner peripheries of the rectangular frame and which are open in vertical and transverse directions with respect to the curtain wall plane, and said panel is grippingly supported in said concave grooves through said seal members to form spaces between the panel and the concave grooves which spaces are contiguous along the four inner peripheries of the rectangular frame and are open to the outside air, and wherein the portions of said connection members which face said concave grooves are covered with said seal members, said seal members having heat insulating and water-tightness properties for portecting the integrity of the heat insulating property of said connection members.

2. A curtain wall panel supporting device as claimed in claim 1, characterized in that said seal members comprises room-inside seal members and room-outside seal members.

3. A curtain wall panel supporting device as claimed in claim 2, characterized in that the portions of said connection members which face said concave grooves are covered with said room-inside seal members.

* * * * *